US005289661A

United States Patent [19]

Jones et al.

[11] Patent Number: 5,289,661

[45] Date of Patent: Mar. 1, 1994

[54] NOTCH BEVELING ON SEMICONDUCTOR WAFER EDGES

[75] Inventors: Joel B. Jones, Bonham; Lawrence D. Dyer, Richardson, both of Tex.

[73] Assignee: Texas Instruments Incorporated, Dallas, Tex.

[21] Appl. No.: 995,447

[22] Filed: Dec. 23, 1992

[51] Int. Cl.[5] ..... B24B 9/08

[52] U.S. Cl. ..... 51/283 E; 51/326; 51/104; 51/105 R; 51/3

[58] Field of Search ..... 51/3, 98 R, 326, 327, 51/283 R, 283 E, 104, 105 R, 284 E

[56] References Cited

U.S. PATENT DOCUMENTS

| | | | |
|---|---|---|---|
| 1,220,287 | 3/1917 | Parsons | 51/98 R |
| 4,344,260 | 8/1982 | Ogiwara | 51/283 E |
| 4,753,049 | 6/1988 | Mori | 51/131.3 |
| 4,905,425 | 3/1990 | Sekigawa | 51/283 E |
| 5,036,624 | 8/1991 | Steere, Jr. | 51/165.71 |

*Primary Examiner*—Jack Lavinder

*Attorney, Agent, or Firm*—Wade James Brady; Richard L. Donaldson

[57] ABSTRACT

An apparatus and method of contouring the edge of a semiconductor wafer in a fiduciary mark notch utilizes a contouring wheel or burr having a smaller diameter than the diameter of the fiduciary mark notch.

14 Claims, 2 Drawing Sheets

NOTCH BEVELING ON SEMICONDUCTOR WAFER EDGES

FIELD OF THE INVENTION

This invention relates to semiconductor wafer manufacture, and more particularly to the method of and apparatus for preparation of a fiducial mark in the edge of the wafer so that the direction orientation in the wafer can be identified in later wafer fabrication processes, and to preparation of the fiducial mark to minimize chip and particle production.

BACKGROUND OF THE INVENTION

During conventional manufacture of semiconductor wafers, a flat is formed on the original crystal ingot by a grinding process. This flat is for the purpose of establishing crystal direction in the wafer for later device fabrication steps.

One of the steps in wafer manufacture is to round the edge of the wafer by a process known as edge grinding. This step avoids edge chipping at later stages in wafer manufacture. The edge grinding or rounding is usually done by an edge grind or edge contouring machine, which presses a grooved grinding wheel against the end of the wafer as it slowly rotates; the groove in the grinding wheel has the opposite shape of the contour that it is designed to generate. The flat also has to be ground to a beveled profile. The beveled or rounded edge is beneficial because it reduces chipping of the wafer edge during later process steps.

Recently, wafers larger than 150 mm have been produced, and a new standard of locating crystal direction has been adopted, namely a notch. A problem with forming the notch is that the usual edge grinding wheel will not reach the bottom of the notch to bevel it.

SUMMARY OF THE INVENTION

The invention is a method of and apparatus using a shaped grinding wheel smaller in radius than that of the fiduciary notch on the edge of the semiconductor wafer to shape the notch edges. The grinding wheel motion is programmed so that the grinding wheel bevels the entire edge of the notch, while maintaining the side of the notch within tolerance.

The semiconductor wafers are edge rounded in the normal process, except that at the end of the edge rounding, a second grinding wheel or notch burr is brought into position against the notched edge, and grinds the edges of the notch. Positioning of the grinding wheel adjacent to the notch may be done several ways: by cam action in which the abrasive wheel is moved by a cam following the contour of the notch; by moving the grinding wheel in the X-Y-Z directions by programming, or by an abrasive wheel that follows the contour of the notch by a spring-loaded or weight-loaded system. Alternately, the wafer may be moved instead of the grinding wheel.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
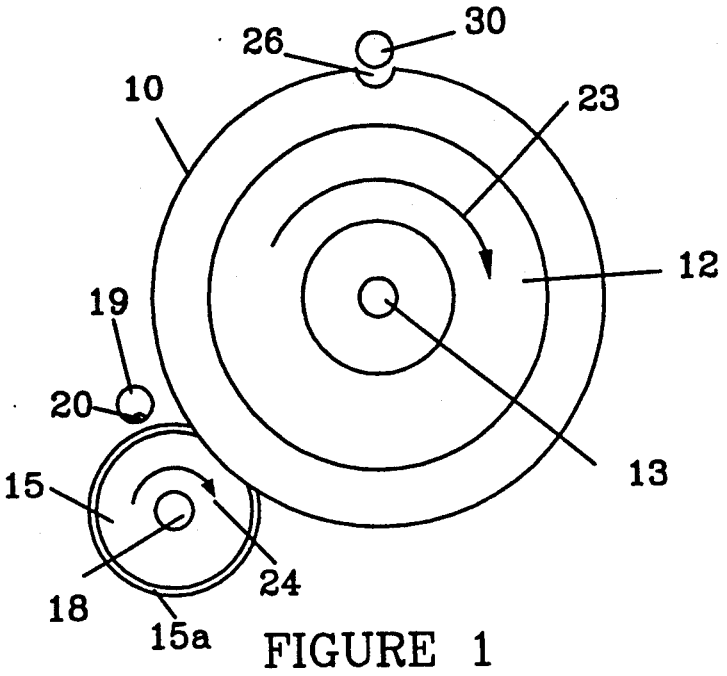
FIG. 1 shows the relative positions of the wafer, edge contouring roller and notch contouring burr.

FIG. 1 is a simplified illustration of the present invention. A semiconductor wafer 10 is held on a vacuum chuck 12 which rotates around shaft 13. Wafer 10 is rotated, for example, in the direction of arrow 23. The wafer is rotated against roller 15 which has a pad 15*a* on its surface.

Tool 15 is rotated by shaft 18, for example, in the direction of arrow 24. As the wafer and contouring tool are rotated, a coolant is applied by dispenser 19 through hole 20.

The relative positions of the semiconductor wafer 10, the edge contouring roller 15, mount on and turned by shaft 18, and notch contouring polishing wheel 30, positioned over notch 26, are shown in FIG. 1

Figure 2:
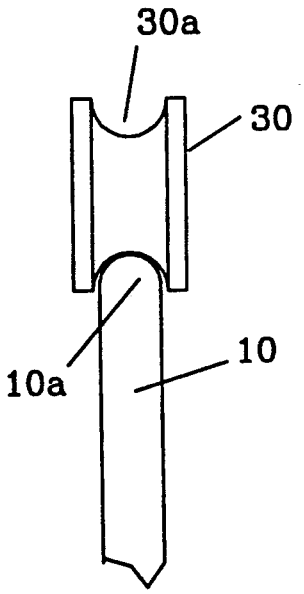
FIG. 2 shows the contouring groove in the notch contouring burr.

FIG. 2 shows the contouring groove in polishing wheel 30. The wafer edge 10*a* is moved into groove 30*a* to shape the wafer edge in the notch on the wafer.

Figure 3:
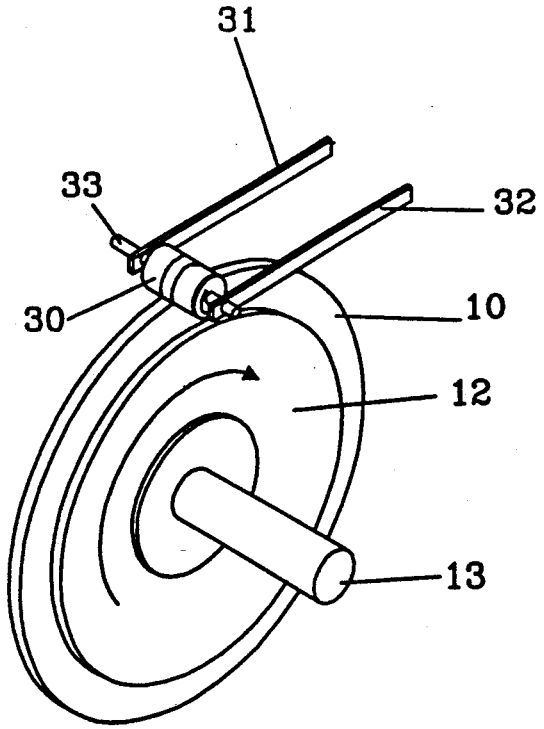
FIG. 3 shows the notch contouring apparatus positioned over the notch in the semiconductor wafer.

FIG. 3 shows, in part, the contouring apparatus of FIG. 1. Polishing wheel 30 has a diameter such that it will move into notch 26 and contour the edges of the notch. Polishing wheel 30 is mounted on shaft 33, which is supported by arms 31 and 32. As wafers 10 are rotated, polishing wheel 30 is rotated and drawn or moved into notch 26 when the notch is under the position of polishing wheel 30 to polish the edge of the wafer in notch 26.

Figure 4:
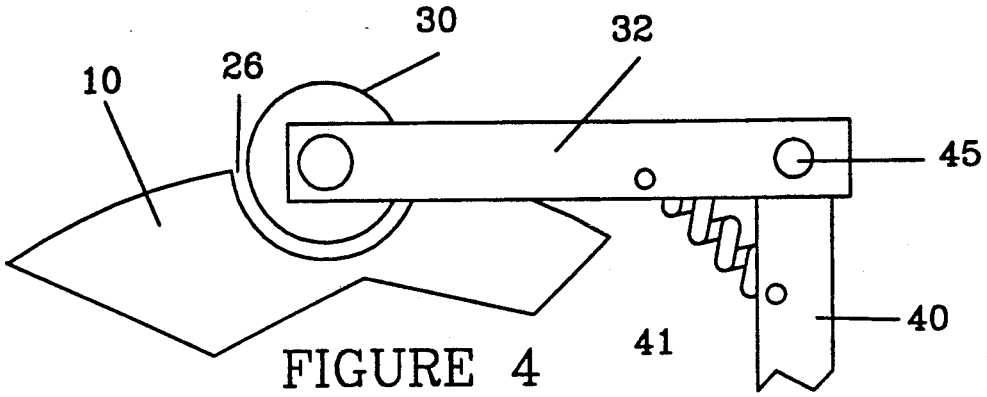
FIG. 4 shows the notch contouring wheel held against the semiconductor wafers by a spring.

FIG. 4 is a partial side view of the semiconductor wafer and polishing wheel 30. Polishing wheel 30 is supported above contouring burr on arms 31 (FIG. 3) and arm 32. Polish wheel 30 rotates around shaft 33. Arm 32 is mounted on support 40 by pin 45. Arm 31 is similarly mounted. Arm 32 pivots on pin 45. Spring 41 holds polish wheel 30 against the edge of wafer 10 and then pulls polish wheel into notch 26 as wafer 10 rotates to move notch 26 under polish wheel 30.

Figure 5:
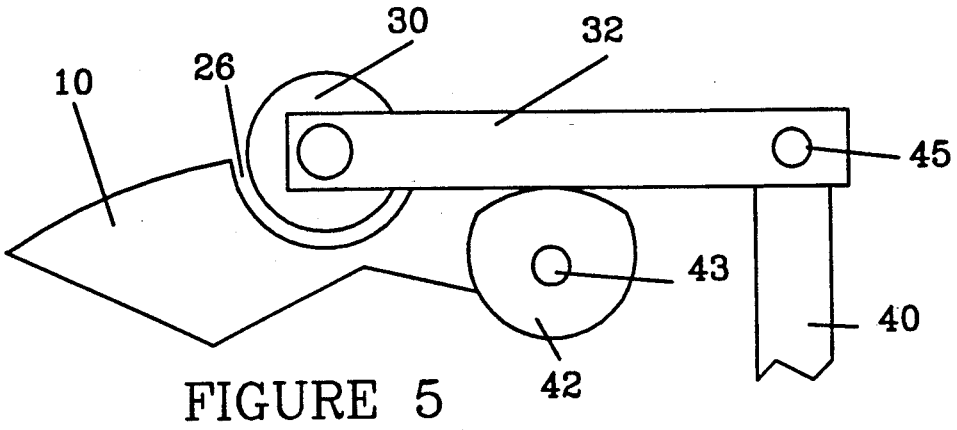
FIG. 5 shows the contouring wheel moved into and out of the notch by a cam.

FIG. 5 illustrates an embodiment in which polish wheel 30 is lowered into notch 26 by cam wheel 42 mounted on shaft 43. Cam wheel 42 can be rotated continuously at a rate that lowers polish wheel 30 into notch 26 as it is positioned over notch 26, or a light sensor, for example, may be used to detect 26 and to cause cam wheel 42 to rotate, and lower polishing wheel 30 into notch 26 as it is moved under polishing wheel 30.

The mounting of contouring burr has been shown mounted on two arms, but any other means of mounting and moving into and out of the fiduciary notch on semiconductor wafer 10 is acceptable to providing contouring of the edges of the notch.

What is claimed is:

1. An apparatus for polishing the edge and the fiduciary mark notch edge on each face of a semiconductor wafer, comprising:

a first polishing wheel for grinding the edge of semiconductor wafer;

a second smaller polishing wheel for polishing simultaneously each face of the edge of the wafer in the fiduciary mark notch; and means for rotating the semiconductor wafer, said first wheel and said polishing wheel during edge and notch polishing.

2. The apparatus according to claim 1, wherein said second polishing wheel has a diameter smaller than the fiduciary mark notch, and a width wider than the semiconductor wafer.

3. The apparatus according to claim 1, wherein said second polishing wheel is moved into the fiduciary mark notch by a spring.

4. The apparatus according to claim 1, wherein said second polishing wheel is moved into the fiduciary mark notch by a spring.

5. The apparatus according to claim 4, wherein the motion of said cam is controlled by a photo cell.

6. An apparatus for polishing the edge and fiduciary mark notch edge on each face of a semiconductor wafer, comprising:

a first polishing wheel for polishing the edge of the semiconductor wafer;

a second polishing wheel for polishing simultaneously each face of the edge of the wafer in the fiduciary mark notch; and means for rotating said semiconductor wafer, said first polishing wheel and said second polishing wheel during polishing; and means for moving the second polishing wheel into and out of the fiduciary mark notch during polishing.

7. The apparatus according to claim 6, wherein said second polishing wheel has a diameter smaller than the fiduciary mark notch.

8. The apparatus according to claim 6, wherein said second polishing wheel is moved into the fiduciary mark notch by a spring.

9. The apparatus according to claim 6, wherein said second polishing wheel is moved into and out of said fiduciary notch by a rotating cam.

10. The apparatus according to claim 9, wherein the motion of said cam is controlled by a photo cell.

11. A method for polishing the edge of a semiconductor wafer and including both sides of the edge of the wafer in a fiduciary mark notch, comprising the steps of:

polishing the edge of the semiconductor wafer with a first polishing wheel;

polishing simultaneously both sides of the edge of the semiconductor wafer in the fiduciary notch with a second polishing wheel; and rotating the semiconductor wafer, first polishing wheel and second polishing wheel during polishing of the wafer edge and the notch edge.

12. The method according to claim 11, wherein the step of polishing the edge of the semiconductor wafer in the fiduciary mark notch including moving a polishing burr having a diameter smaller than the diameter of the fiduciary mark notch into the notch during polishing.

13. The method according to claim 11, including the step of moving the second polish roller into the fiduciary mark notch with a spring.

14. The method according to claim 11, including the step of moving the second polishing wheel into the fiduciary mark notch with a cam.

* * * * *